United States Patent [19]

Ruscitti et al.

[11] Patent Number: 4,979,678

[45] Date of Patent: Dec. 25, 1990

[54] ATOMIZER NOZZLE INSERT FOR HAND PUMPS, PARTICULARLY FOR LACQUERS

[75] Inventors: Tommaso Ruscitti, Milan; Davide Cutilli, Penne, both of Italy

[73] Assignee: S.A.R. S.p.A., Chieti, Italy

[21] Appl. No.: 353,038

[22] Filed: May 17, 1989

[30] Foreign Application Priority Data

Jun. 28, 1988 [IT] Italy ..... 21140 A/88

[51] Int. Cl.[5] ..... B05B 1/34

[52] U.S. Cl. ..... 239/466; 239/492

[58] Field of Search ..... 239/466, 487–489, 239/491–493

[56] References Cited

U.S. PATENT DOCUMENTS 356,372 1/1887 Parker ..... 239/481

2,668,084 2/1954 Saxton ..... 239/491

3,129,893 4/1964 Green ..... 239/490

*Primary Examiner*—Andres Kashnikow

*Assistant Examiner*—Karen B. Merritt

*Attorney, Agent, or Firm*—Oblon, Spivak, McClelland, Maier & Neustadt

[57] ABSTRACT

An atomizer nozzle insert for hand pumps mounted on bottles, for the atomized dispensing of liquid products contained in said bottles, is of cup shape and comprises at least one turbulence channel of spiral extension provided in the inner end surface of the insert and opening into a coaxial turbulence chamber which communicates with the outside via a coaxial outlet bore for the atomized product. The turbulence channel also extends, with substantially helical extension, along the inner lateral wall of the insert.

3 Claims, 2 Drawing Sheets

ATOMIZER NOZZLE INSERT FOR HAND PUMPS, PARTICULARLY FOR LACQUERS

BACKGROUND OF THE INVENTION

This invention relates to atomizer nozzle inserts for hand pumps mounted on bottles, for the atomized dispensing of liquid products contained in such bottles.

An atomizer nozzle insert 10 of known type is shown in FIGS. 1 and 2.

As can be seen from the figures, the insert 10 is substantially of cup form. The insert 10 is forcibly inserted into a suitable circular hole 11 provided in the atomizer nozzle body 12 (shown by dashed lines in FIG. 2). In inserting the insert 10 into the hole 11 in the atomizer nozzle, the cylindrical nosepiece 14 (also shown by dashed lines) itself becomes inserted into the insert 10 until it rests against the end wall 16 of the insert 10. The cylindrical nosepiece 14 has a diameter slightly less than the minimum diameter of the slightly frusto-conical cavity 18 in the insert 10, so as to form with the insert an annular channel 22. This latter communicates with the inner cavity of the rod of the pump (not shown in the figures), from which the product to be dispensed emerges.

As can be better seen in FIG. 1, in the inner end wall 16 of the insert 10 there are provided three straight tapering turbulence channels 26, 28, 30 extending from the periphery of the end wall 16 and opening tangentially into a cylindrical turbulence chamber 32, coaxial with the insert 10. A coaxial outlet bore 34 connects the turbulence chamber 32 to the outside.

Because of the particular form and arrangement of the turbulence channels 26, 28 and 30 and turbulence chamber 32, the liquid dispensed by the hand pump leaves through the insert bore 34 in an atomized state.

However certain products, such as lacquers, are more difficult to atomize because of the additives which they contain. Consequently it can happen that on pressing the dispenser knob with the finger, the product is insufficiently atomized or a substantially greater than normal force has to be exerted on said dispenser knob to obtain the required atomization.

SUMMARY OF THE INVENTION

The object of the present invention is to provide an atomizer nozzle insert which does not have the aforesaid drawbacks and which enables the required atomization to be obtained even for products difficult to atomize, without it being necessary to exert a substantially greater than normal force on the dispenser knob.

Said object is attained by the atomizer nozzle insert according to the invention, said insert being of substantially cup shape and being characterised by comprising at least one turbulence channel of substantially spiral extension provided in the inner end surface of the insert and opening into a coaxial turbulence chamber which communicates with the outside via a coaxial outlet bore for the atomizer product, said turbulence channel also continuing, with substantially helical extension, along the inner lateral wall of the insert.

This enables the required product atomization to be obtained even in the case of products difficult to atomize.

The turbulence channels are preferably two in number. More than three channels are difficult to obtain because of the small dimensions of the insert.

It has been verified experimentally that for a given number of channels, optimum results are obtained with channels having a cross-section which reduces in progressing towards the turbulence chamber.

Tests carried out have shown that the insert according to the invention results in greater size uniformity of the atomized liquid particles.

In all cases, comparing the results obtained by the insert according to the invention with those of known inserts, it is found that for a given force exerted on the dispenser knob, the atomized liquid particles have an average diameter less than that of the particles obtained by known inserts. In addition, the particle diameter dispersion is less. Vice versa, a smaller force is required to obtain the same average atomized liquid particle diameter as obtained by known inserts.

Consequently, with the insert according to the invention excellent atomization is obtained even of those substances which with known inserts are atomized incompletely, with the production of droplets.

DESCRIPTION OF THE PREFERRED EMBODIMENT(S)

Figure 2:
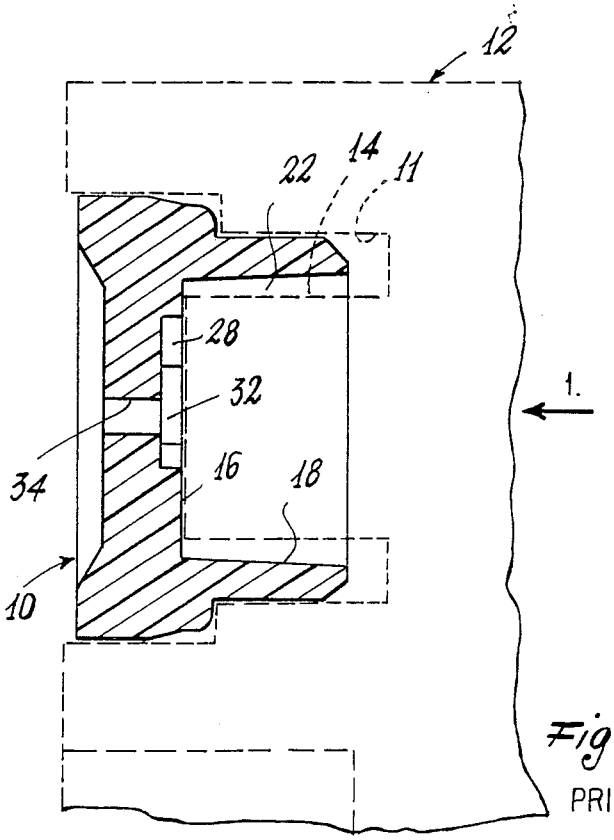
Fig. 2 PRIOR ART
FIG. 2 is a diametrical cross-section of the known insert taken through line II—II of FIG. 1.
Figure 3:
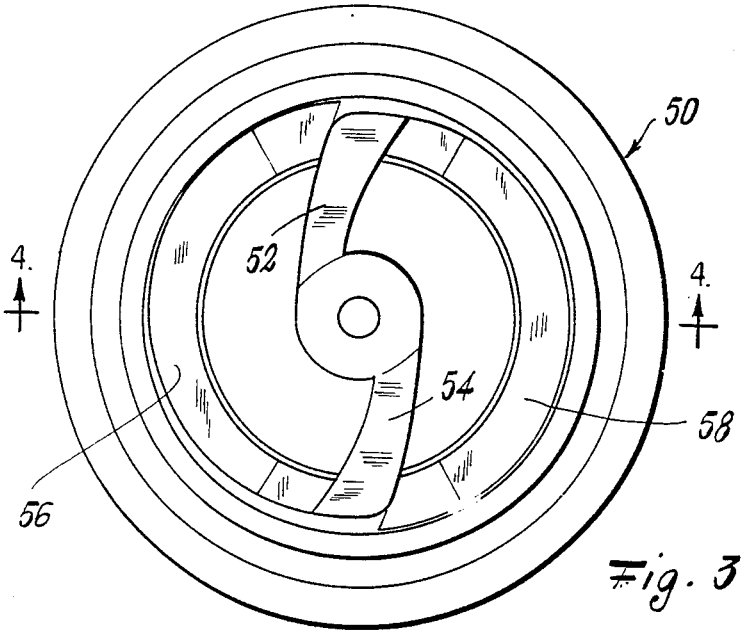
FIG. 3 is a front view of the insert according to the invention, analogous to that of FIG. 1.
Figure 4:
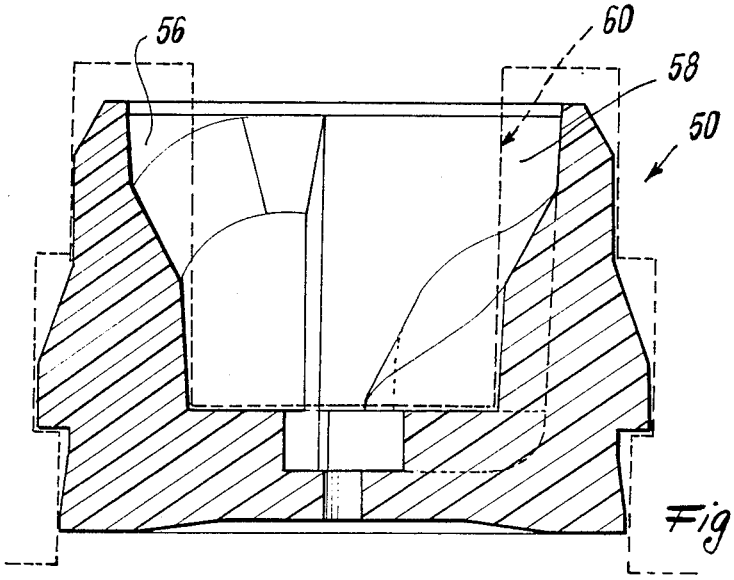
FIG. 4 is a diametrical section therethrough on the line IV—IV of FIG. 3.

FIGS. 3 and 4 shown for simplicity an insert 50 having two turbulence channels. It is however apparent to the expert of the art that the number of channels could be one only, or more than two, for example three, as in the case of the known insert shown in FIGS. 1 and 2.

Figure 1:
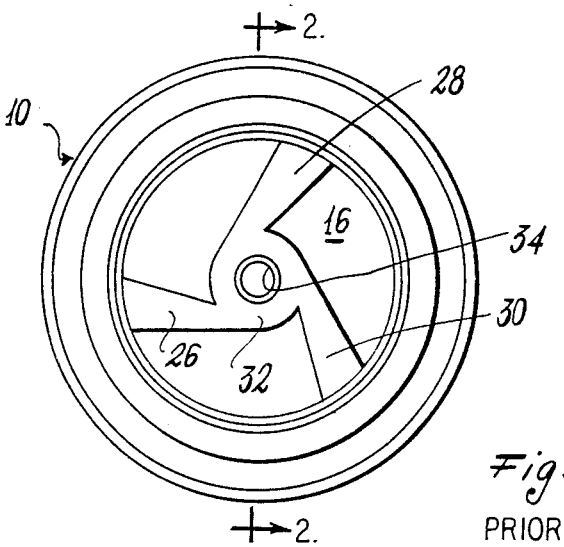
Fig. 1 PRIOR ART
FIG. 1 is a planar view of a known insert viewed in the direction of arrow I of FIG. 2.

The insert 50 is still of substantially cup shape, but comprises turbulence channels of substantially spiral extension in their terminal portion 52, 54 (best visible in FIG. 3), whereas the turbulence channels 26, 28 and 30 of the known insert are of straight extension, as can be best seen in FIG. 1.

The other basic difference is apparent from FIG. 4. In this it can be seen that each of the two turbulence channels comprises a cylindrical portion 56, 58 respectively, provided in the inner lateral wall of the insert. As in the case of known inserts, the dispenser nosepiece (shown by dashed lines in FIG. 4) is inserted into the insert 50, with the result that the initial portion 56, 58 of each channel commences with a half-ring shaped section and then gradually narrows, following an overall helical pattern, until it joins up with the relative said terminal portion 52 and 54 of spiral shape.

It has been found that even though the initial helical portions of the turbulence channels are of substantially constant cross-section equal to the initial cross-section of the spiral terminal portion of the turbulence channels, a substantial improvement in atomization conditions is obtained.

With the described insert 50, excellent atomization without droplet formation is obtained even of those products which because of the additives which they contain are difficult to atomize without exerting on the dispenser knob a force decidedly greater than that normally required.

We claim:

1. An atomizer nozzle insert for hand pumps mounted on bottles, for the atomized dispensing of liquid products contained in said bottles, the insert being of substantially cup shape with an inner lateral wall and inner end surface and comprising a turbulence channel having a terminal portion and an initial portion, the terminal portion being of substantially spiral extension provided in the inner end surface of the insert and opening into a coaxial turbulence chamber which communicates with the outside via a coaxial outlet bore for the atomized product, and the initial portion of said turbulence channel continuing from said terminal portion, with a substantially helical extension, along the inner lateral wall of the insert.

2. An insert as claimed in claim 1, wherein two turbulence channels are provided.

3. An insert as claimed in claim 1 or 2, wherein each turbulence channel has a cross-section which reduces progressively towards the turbulence chamber.

* * * * *